United States Patent [19]

Dutcher

[11] 4,153,196

[45] May 8, 1979

[54] TUB-SHAPED CARTON AND BLANK FOR FORMING SAME

[75] Inventor: Daniel P. Dutcher, Woodbury, Minn.

[73] Assignee: Champion International Corporation, Stamford, Conn.

[21] Appl. No.: 829,720

[22] Filed: Sep. 1, 1977

[51] Int. Cl.[2] ..... B65D 3/04; B65D 5/24

[52] U.S. Cl. ..... 229/1.5 B; 229/21

[58] Field of Search ..... 229/1.5 B, 31, 21

[56] References Cited

U.S. PATENT DOCUMENTS

| | | | |
|---|---|---|---|
| 2,240,599 | 5/1941 | Amberg | 229/1.5 B |
| 3,633,814 | 1/1972 | Michetti | 229/1.5 B |
| 3,733,023 | 5/1973 | Arneson | 229/1.5 B |
| 3,901,431 | 8/1975 | Carlson | 229/21 |
| 3,977,594 | 8/1976 | Swan | 229/41 C X |

FOREIGN PATENT DOCUMENTS

| | | | |
|---|---|---|---|
| 735800 | 8/1955 | United Kingdom | 229/1.5 B |

*Primary Examiner*—Davis T. Moorhead

*Attorney, Agent, or Firm*—Evelyn M. Sommer

[57] ABSTRACT

A generally cylindrical, tub-shaped carton having a reinforced flat bottom, and particularly suited for containing butter or margarine, is formed of a single paperboard blank, and is characterized by having a generally cylindrical-shaped side wall formed of two panels, each of which is hingedly connected to a horizontal base portion. The latter includes a rectangularly-shaped central portion to which is integrally connected on opposite sides thereof two triangularly-shaped base portions. Intermediate each triangularly-shaped base portion and a side wall panel is an articulated webbed corner which, in the erected position of the carton, is of multiple paperboard sheet construction, and which functions to reinforce the base of the tub-shaped carton. The hexagonal base or bottom of the carton is flat, thereby offering a more stable carton having greater capacity at reduced cost of manufacture, and also offering better sealing of the carton during packaging of the butter therein.

15 Claims, 6 Drawing Figures

TUB-SHAPED CARTON AND BLANK FOR FORMING SAME

The present invention relates to a new and improved carton, and more particularly a generally cylindrical tub-shaped carton and blank for making same, which is particularly suited for containing a food product, such as butter or margarine. The carton of the subject invention is formed of a single sheet of paperboard material having a new and unique configuration so as to result in a cylindrical container, having an unobstructed top portion, and a flat, reinforced rigid base portion, thereby greatly facilitating the loading of the carton with butter or margarine, and offering increased capacity, at reduced manufacturing cost of the carton. In addition, when employing conventional carton filling equipment, the flat bottom offers improved sealing capability of the resulting carton even under application of a mandrel pressure during packaging of the food products into the carton.

Heretofore, semi-soft food products, such as butter or margarine, have been packaged in paper outer wrappers, and more recently in molded plastic containers of generally tub-shaped configuration. Because of the molding operation and the cost of manufacture, it is appreciated that the cost of the resulting plastic container is relatively high, as compared to a container formed of a paper or paperboard material. It is also known to provide cartons of tub-shaped configuration formed of a single paperboard blank wherein, in order to achieve a cylindrical configuration of the carton from a single blank, the base of the resulting carton has included arcuate portions or depressions, thereby decreasing the volume of the resulting carton, and creating, in effect, false bottoms in the carton. Furthermore, with such depressions or false bottoms, the resulting base of such carton is not flat, and thus is less stable than desired, especially during filling of the carton with the food product.

It is an object of the subject invention to overcome the shortcomings of the prior art paperboard cartons, and to provide a new and improved tub-shaped carton having a reinforced flat bottom, and yet formed of a single sheet of paperboard material. In the subject invention, a tub-shaped carton is formed of a single sheet of paperboard material and basically comprises two side wall panels that are hingedly connected to a horizontally disposed hexagonal base. The hexagonal base includes a rectangularly-shaped central portion, two triangularly-shaped base portions which are integrally connected to opposite sides of the central rectangular portion, and four intermediate articulated webbed corners. Each webbed corner is hingedly connected between one side of a triangularly-shaped base portion and one side wall panel, and in the erected condition of the carton, the articulated webbed corners are folded so as to be wholly disposed within the tub-shaped carton, and in a position contiguous with and overlying associated triangularly-shaped base portion for reinforcing same, and at the same time insuring that the bottom of the tub-shaped carton is flat.

Further objects and advantages of the invention will become apparent from the following detailed description taken in conjunction with the figures in which.

Figure 1:
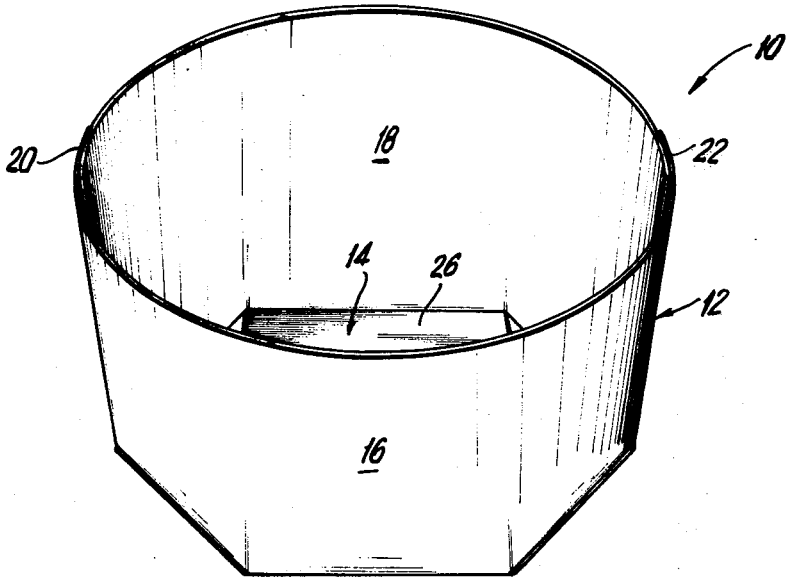
FIG. 1 is a perspective view of a tub-shaped carton of the subject invention.
Figure 2:
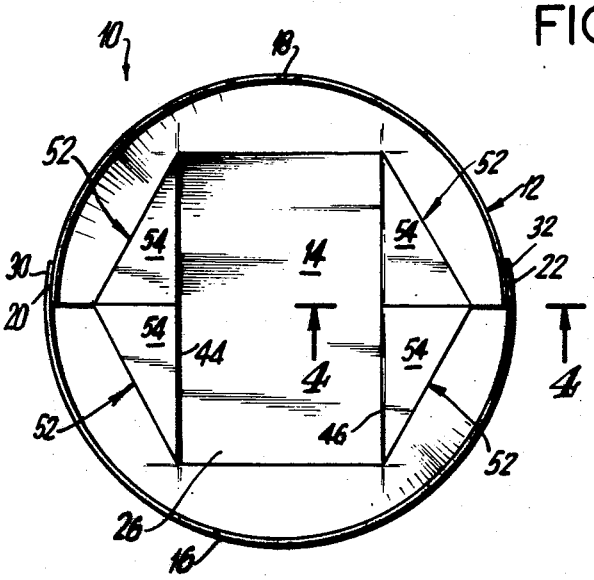
FIG. 2 is a top plan view of the tub-shaped carton of FIG. 1.
Figure 3:
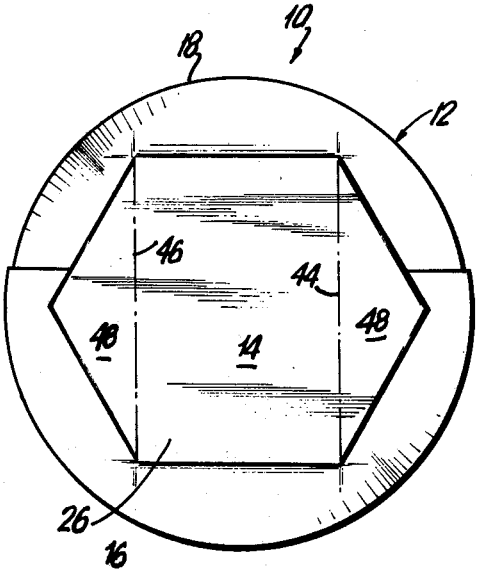
FIG. 3 is a bottom view of the tub-shaped carton of the subject invention.
Figure 4:
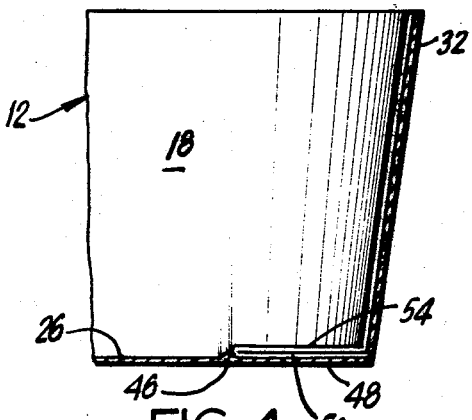
FIG. 4 is a sectional view taken along line 4—4 in FIG. 2.

Referring to FIGS. 1 through 3, the tub-shaped carton of the subject invention is generally cylindrical in configuration, and designated by the numeral 10. Preferably the carton is formed of a single sheet of paperboard material, with the blank for forming the carton being illustrated in FIG. 6. As shown in FIGS. 1 through 3, tub-shaped carton 10 includes upstanding side wall 12 which is hingedly connected to a horizontally disposed base portion 14 that is generally flat. The side wall 12 is formed by two arcuate panels 16 and 18 which are connected along opposed seams 20 and 22, such as by bonding with adhesive material. As shown in FIGS. 2 and 3, the hexagonal base or bottom 14 of the carton 10 is generally flat, and includes a central portion 26 and integrally formed triangular-shaped side base portions 48 that are overlapped by triangular segments 54 and 56 of the carton to provide a reinforced base fixture for the carton, as more fully described hereinafter.

Figure 6:
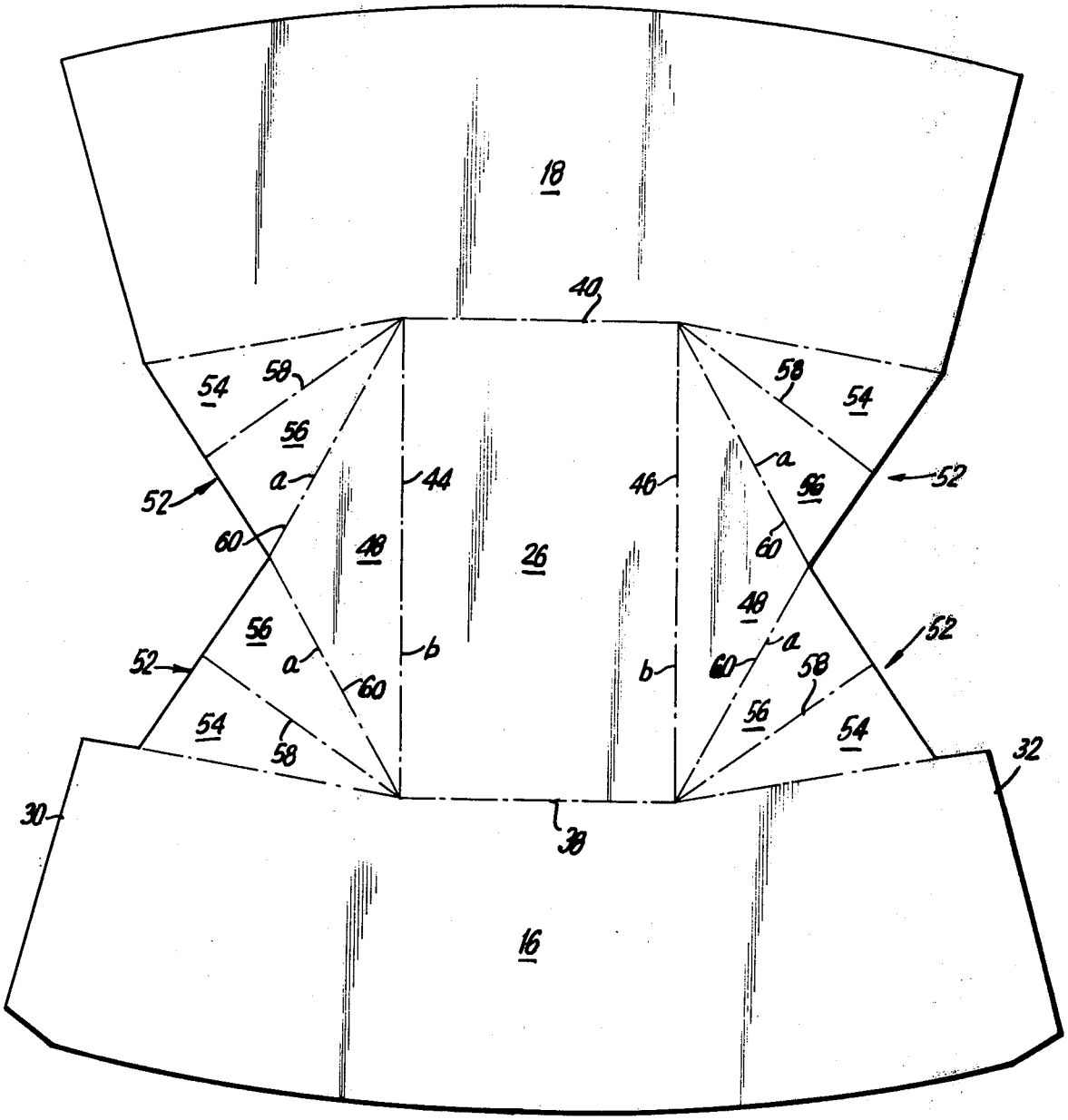
FIG. 6 is a plan view of a blank for forming the tub-shaped carton of the subject invention.

Referring to FIG. 6, the blank for forming carton 10 is preferably formed of a single sheet of paperboard material and includes first side panel 16 that is arcuate and is hingedly connected along hinge line 38 to the central base portion 26. Disposed on opposite edges of first side panel 16 are glue flaps 30 and 32 which form seams 20 and 22, as shown in FIG. 1. The second side panel 18 is also arcuate in configuration and is hingedly connected to the opposite side of central panel 26 along hinge line 40. The remaining two opposed edges of central panel 26 define lines 44 and 46 for integrally connecting the central base to two triangularly-shaped side base portions, each designated by the numeral 48. Each triangularly-shaped side base 48 is preferably an isoceles triangle, having two equal sides "a", with the unequal side "b" being contiguous with the respective hinge lines 44, 46 to the central base 26. Hingedly connected to one of the two equal sides "a" of each triangularly-shaped base 48, as well as to one of the side panels 16 or 18, is one of four intermediate webbed corners, designated by the numeral 52. Each webbed corner 52 includes two articulated, generally triangular segments 54 and 56 which are hingedly connected along line 58, and hingedly connected to its associated triangular-shaped base 48 along hinge line 60. Segment 54 of each intermediate webbed corner 52 is, in turn, hingedly connected to the first or second side panels along hinge lines 38 and 40, respectively.

Figure 5:
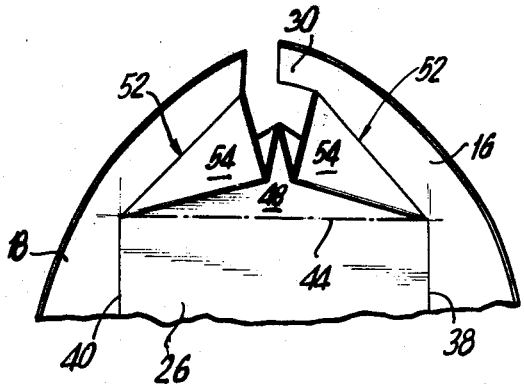
FIG. 5 is a partial perspective view of a tub-shaped carton of the subject invention during a stage of the erection of the carton.

As shown in FIG. 5, during the erection of carton 10, each intermediate webbed corner 52 is folded about its central hinge line 58, and then about its associated hinge line 60 and hinge lines 38 or 40 so that each intermediate webbed corner is disposed wholly within the confines of the resulting tub-shaped carton. The partial erected position of the carton 10 is illustrated in FIG. 5, and it is noted that each triangularly-shaped base portion 48 is disposed beneath its associated intermediate webbed corners 52. In the final erected condition of the carton 10, glue flaps 30 and 32 are bonded to the opposed edges of the second side panel 18. At such time, as illustrated in FIG. 5, the triangular-shaped segments 54 and 56 of each intermediate webbed corner 52 are in contiguous disposition, and in flattened condition against the associated triangularly-shaped base 48. As a result, the entire bottom or hexagonal base 14 of the carton 10 is flat, and as such does not present a false bottom, thereby resulting in a more structurally stable carton, providing greater interior volume.

Accordingly, there is provided a new and improved tub-shaped carton, particularly suited for use in containing foodstuffs, such as butter or margarine, and which is formed of a single paperboard blank. The resulting carton has a structurally reinforced flat bottom, which is achieved by the new and improved structure of applicant's carton blank; which blank structure, when fully erected, provides the desired configuration of the carton, and the required strength for packaging of the foodstuffs. Since the blank is formed from a single blank paperboard material, the resulting costs of manufacture of the carton is less than heretofore achieved, especially compared to cartons formed of molded plastic articles. Furthermore, the flat hexagonal bottom of the subject carton provides a more stable structural carton than heretofore achieved from paperboard cartons having false bottoms or depressions.

Although the invention has been described with respect to a single embodiment, it is readily apparent that various modifications or alterations may be made in the subject carton and blank for forming same, without departing from the spirit and scope of the invention as defined by the appended claims.

What is claimed is:

1. A tub shaped carton comprising:
a cylindrically-shaped side wall formed of two panels;
said panels being hingedly connected at the bottom edges thereof to a horizontally disposed hexagonal base, said base including:
a rectangularly-shaped central portion hingedly connected along two opposite sides thereof to said two wall panels respectively;
two triangularly-shaped side base portions, each integrally connected along one side thereof to one of the other opposed sides of the central rectangular section; and
four intermediate articulated webbed corners, each hingedly connected between one side of a triangularly-shaped base portion and a side wall panel, with each said articulated webbed corner being disposed wholly within said tub shaped carton so as to provide a reinforced flat bottom base for said tub-shaped carton.

2. A tub shaped carton as recited in claim 1, wherein said two side wall panels are bonded together.

3. A tub shaped carton as recited in claim 1, wherein each triangularly-shaped base portion defines a generally isosceles triangle.

4. A tub shaped carton as recited in claim 1, wherein one side wall panel include glue flaps secured to the opposite edges thereof.

5. A tub shaped carton as recited in claim 1, wherein each of said intermediate webbed corners includes two articulated generally triangular segments.

6. A tub shaped carton as recited in claim 1, wherein said carton is formed of a single sheet of paperboard material.

7. A tub shaped carton comprising:
a cylindrically shaped side wall formed of two panels; said panels being hingedly connected at the bottom edges thereof to a horizontally disposed hexagonal base; said base including:
a generally rectangularly shaped central portion hingedly connected along two opposite sides thereof to said two wall panels respectively;
two triangularly shaped side base portions, each triangular base portion being of an isosceles triangle design, with the unequal side of each isosceles triangle base portion being hingedly integrally connected to one of the other opposed sides of the central rectangular section; and
four intermediate articulated webbed corners, each formed of two articulated generally triangular segments, each webbed corner being hingedly connected to one side of a triangularly shaped base portion and to a side wall panel, with each intermediate articulated webbed corner being wholly disposed within said tub shaped carton so as to provide a reinforced flat bottom base for said tub shaped carton.

8. A tub shaped carton as recited in claim 7 wherein said side wall panels are bonded together.

9. A tub shaped carton as recited in claim 7 wherein one side wall panel includes glue flaps secured to opposite edges thereof.

10. A tub shaped carton as recited in claim 7 wherein the carton is made of a single sheet of paperboard material.

11. A blank for forming a tub shaped carton comprising:
a first side wall panel;
a generally rectangular, central base portion hingedly connected along one edge thereof to said first side wall panel;
a second side wall panel hingedly connected to said central base portion along an edge thereof opposite to said one edge to which the first side is connected;
two generally triangular-shaped side base portions respectively integrally connected to the other two opposed edges of said central base portion to form a hexagonal base; and
four intermediate articulated webbed corners, each hingedly connected between one side of a triangular-shaped base portion and a side wall panel.

12. A blank for forming a tub shaped carton as recited in claim 11, wherein said blank is formed of a single sheet of paperboard material.

13. A blank for forming a tub shaped carton as recited in claim 11 wherein said first side wall panel includes glue flaps on opposite edges thereof.

14. A blank for forming a tub shaped carton as recited in claim 11 wherein said first and second wall panels are generally arcuate.

15. A blank for forming a tub shaped carton as recited in claim 11 wherein each of said intermediate webbed corners include two articulated generally triangular segments.

* * * * *

UNITED STATES PATENT AND TRADEMARK OFFICE

CERTIFICATE OF CORRECTION

PATENT NO. : 4,153,196

DATED : May 8, 1979

INVENTOR(S) : Daniel P. Dutcher

It is certified that error appears in the above-identified patent and that said Letters Patent are hereby corrected as shown below:

In Column 4, line 15, delete "hingedly".

Signed and Sealed this

*Thirteenth* Day of *May 1980*

[SEAL]

*Attest:*

SIDNEY A. DIAMOND

*Attesting Officer*

*Commissioner of Patents and Trademarks*